US006048048A

United States Patent [19]

Gregoire

[11] Patent Number: 6,048,048

[45] Date of Patent: Apr. 11, 2000

[54] POSTAL PRINTHEAD PROVIDED WITH A DEVICE FOR ADJUSTING ALIGNMENT

[75] Inventor: Jean-Pierre Gregoire, Brie Comte Robert, France

[73] Assignee: Neopost Industrie, Bagneux, France

[21] Appl. No.: 09/012,187

[22] Filed: Jan. 23, 1998

[30] Foreign Application Priority Data

Jan. 24, 1997 [FR] France ..... 97 00761

[51] Int. Cl.[7] ..... B41J 2/21

[52] U.S. Cl. ..... 347/40; 347/41

[58] Field of Search ..... 347/40, 41, 42, 347/43; 400/82

[56] References Cited

U.S. PATENT DOCUMENTS 5,038,153 8/1991 Liechti et al. .

5,821,957 10/1998 Berge et al. ..... 347/40

FOREIGN PATENT DOCUMENTS 0 702 334 A1 3/1996 European Pat. Off. .

OTHER PUBLICATIONS

Patent Abstracts of Japan, vol. 011, No. 067 (M–566), Feb. 28, 1987 corresponding to JP 61 225064 A (Nec Home Electronics Ltd), Oct. 6, 1986.

Patent Abstracts of Japan, vol. 010, No. 270 (M–517), Sep. 13, 1986 corresponding to JP 61 092863 A (Fujitsu Ltd), May 10, 1986.

Patent Abstracts of Japan, vol. 010, No. 066 (M–461), Mar. 15, 1986 corresponding to JP 60 210468 A (Konishiroku Shashin Kogyo KK), Oct. 22, 1985.

Patent Abstracts of Japan, vol. 008, No. 032 (M–275), Feb. 10, 1984 cocrresponding to JP 58 188661A (Canon KK), Nov. 4, 1983.

Patent Abstracts of Japan, vol. 006, No. 193 (M–160), Oct 2, 1982 corresponding to 57 100081 A (Seiko Epson Corp) Jun. 22, 1982.

Patent Abstracts of Japan, vol. 006, No. 120 (M–140) Jul. 3, 1982 corresponding to JP 57 047671 A (Ricoh Co Ltd) Mar. 18, 1982.

Patent Abstracts of Japan, vol. 096, No. 012, Dec. 26, 1996 corresponding to JP 08 197721 A (Fuji Electric Co Ltd), Aug. 6, 1996.

*Primary Examiner*—John Barlow
*Assistant Examiner*—Lamson D. Nguyen
*Attorney, Agent, or Firm*—Sughrue, Mion, Zinn, Macpeak & Seas, PLLC

[57] ABSTRACT

An inkjet printhead for a franking machine for printing a postage imprint on an item to be franked, which item is displaced relative to the head in a movement direction, said printhead including: a plurality of nozzles disposed in two rows extending transversely to the direction of movement and mounted in respective modules which are mutually offset transversely and lengthwise relative to the direction of movement and which are spaced apart from each other by a distance D in said direction; a first mechanism for moving one module in a direction transverse to the movement direction; and a second mechanism for moving the other module through an angle relative to the direction transverse to the movement direction, which angle is determined so that during printing one end nozzle of one row coincides with one end nozzle of the other row.

7 Claims, 2 Drawing Sheets

POSTAL PRINTHEAD PROVIDED WITH A DEVICE FOR ADJUSTING ALIGNMENT

FIELD OF THE INVENTION

The present invention concerns the exclusive field of mail processing. It is more particularly concerned with a device for adjusting the alignment of the inkjet printhead of a postage meter or "franking machine" for franking postage imprints on items to be franked moved relative to the head in a movement direction, the printhead including a plurality of nozzles disposed in two rows extending transversely to the movement direction, the two rows being spaced from each other by a distance D in this direction and control means being provided to control the chronological succession of ejection of droplets of ink from the plurality of nozzles in such a manner as to delay the ejection of droplets of ink from the nozzles of one of the two rows relative to that from the nozzles of the other row by a time-delay R based on previously recorded data representative of an estimate of the distance D.

DESCRIPTION OF THE RELATED

An inkjet franking machine is known from document U.S. Pat. No. 5,083,153. Inkjet printing makes franking machines very flexible, in particular in the case of printing onto mail items postage imprints including both variable characters, such as the numerical symbols of a franking amount, and dispositions of colors, such as advertising slogans.

In one simple and economic arrangement of the printhead, the two rows of nozzles can be parts of respective modules offset from each other transversely to and lengthwise of the direction of movement. Small modules including a row of inkjet nozzles, for example, modules including 64 or 128 nozzles, are now readily available at very low cost for use in inkjet printers to be connected to microcomputers. These inkjet printing modules have a resolution of approximately 200 nozzles per inch (i.e. a nozzle every 0.127 mm), which is perfectly suitable for printing a postage imprint. The linear mark printed by a module including 128 nozzles, for example, extends approximately 16 mm. Obviously, two modules each including a row of 128 nozzles can print a linear mark over a length of approximately 30 mm, which corresponds to the height of a postage imprint.

The information to be printed by a franking machine of this kind on a letter or on a label intended to be affixed to a letter, for example a linear mark perpendicular to the direction of movement, is stored in digital form in a memory and a portion of it is transmitted to an interface circuit which, under the control of the control means, simultaneously activates the nozzles of the more upstream row along which the mail item or the label is displaced by the distance D. Another portion of the information in the memory is transmitted to the interface circuit which simultaneously activates all the nozzles of the other row to finish the printing of the linear mark.

The time-delay R in question can be supplied by a clock circuit at a fixed frequency if variations in the speed of movement V of the letter or the label under the printhead are ignored or at a frequency which is synchronized to a signal representative of the speed of movement of the letter or the label sensed in real time by an appropriate speed sensor, for example an optical sensor.

In accordance with this principle, to obtain a linear mark of the above kind of satisfactory quality it is necessary for the two modules to be mounted so that facing ends of the rows of nozzles (each defined by one nozzle) are spaced from each other in the direction transverse to the direction of movement by a distance equal to approximately 0.127 mm; i.e. the distance between two consecutive nozzles of either row of nozzles. In this way it is possible to retain the same resolution over the entire length of the linear mark, i.e. to print over the full height of a postage imprint lines lengthwise of the direction of movement that are regularly spaced from each other.

In practice it is difficult to obtain a disposition of the rows of nozzles that is this accurate, and it is easier to mount the two modules with some tolerance and to use an appropriate adjustment method to achieve perfect alignment of the nozzles of the two modules. The applicants' French applications FR 2 724 591 and FR 2 724 592 are illustrative of such methods.

SUMMARY OF THE INVENTION

The applicant has found in the course of repeated tests that a small angular offset of the two rows of nozzles is preferable to even a very small lateral offset of the two rows of nozzles. In the former case the resulting postage imprint has visual defects that are much less noticeable, with an imperceptible change in the direction of the line, than in the latter case where the visual defects are obvious, with a visible jag in the line.

The object of the present invention is to provide a franking machine printhead with an integral alignment adjustment device which, based on the above discovery, eliminates the need for the prior art adjustment methods. An aim of the invention is to obtain alignment of the nozzles simply by immobilizing the two modules containing these nozzles relative to each other. Another aim of the invention is to achieve such immobilization in a simple and reliable manner with a minimum number of components.

These aims are achieved by a franking machine inkjet printhead for printing a postage imprint on an item to be franked, which item is displaced relative to the head in a movement direction F, said printhead including a plurality of nozzles B1–B128, B́1–B́128 disposed in two rows R1, R2 extending transversely to the direction of movement, said two rows of nozzles being mounted in respective modules which are mutually offset both transversely and lengthwise relative to the direction of movement and which are spaced apart from each other by a distance D in said direction, the printhead further including first means for moving one module in a direction transverse to the movement direction F and second means for moving the other module through an angle relative to said direction transverse to the movement direction F, which angle is determined so that during printing one end nozzle of one row coincides with one end nozzle of the other row.

The first module is fixed into the body transversely between a fixed abutment fastened to said body and a second spring member and longitudinally between a first fixed support and a first mobile support onto which it is pressed by a first spring member which applies a compression force in a middle area of said first module.

The first mobile support is advantageously one end of a first lever that is pivoted about a first pivot pin fastened to the body by a first screw to cause angular movement of one end of the first module around the first fixed support on which the other end of the first module rests.

The second module is fixed into the body longitudinally between second and third fixed supports onto which it is pressed by the first spring member which applies a compression force in the middle area of said second module and transversely between the second spring member and a second mobile support.

The second mobile support is advantageously one end of a second lever that is pivoted about a second pivot pin fastened to the body by a second screw to cause transverse movement of the second module.

The first and second screws are preferably lockable fine-pitch screws and the first spring member is preferably a leaf spring.

BRIEF DESCRIPTION OF THE DRAWINGS

Other features and advantages of the present invention become more apparent from the following description given by way of non-limiting example with reference to the accompanying drawings, in which.

DETAILED DESCRIPTION OF A PREFERRED EMBODIMENT

Figure 1:
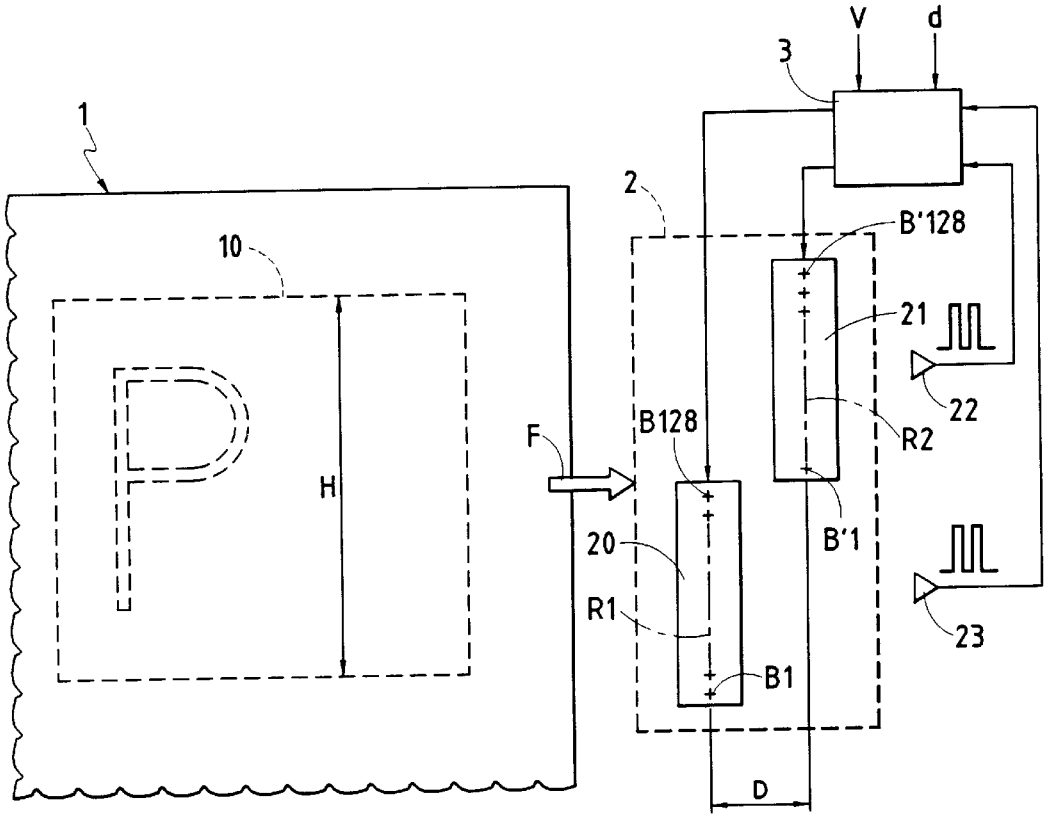
FIG. 1 is a simplified block schematic of a franking machine.

The franking machine of FIG. 1 includes a conveyor system that displaces the mail item 1 to be franked under a stationary inkjet printhead 2 in the direction of movement F.

The printhead includes two modules 20 and 21 each having a row of nozzles, each row including 128 nozzles regularly spaced by a distance of 1/200 inch, i.e. approximately 0.127 millimeter, for example. Note that, if necessary, the modules can have rows of different sizes, for example a module with 128 nozzles and a module with 64 nozzles. In the present example, the modules 20 and 21 are identical.

The two modules are mounted in the printhead 2 so that their rows of nozzles extend transversely to the direction F, the two modules being mutually offset both transversely and lengthwise relative to the direction F.

The nozzles are represented by crosses in FIG. 1. The arrangement of the two modules 20 and 21 is such that the distance between the last nozzle B́128 (the uppermost one in FIG. 1) of the module 21 and the first nozzle B1 (the lowermost one in FIG. 1) of the module 20 is at least equal to the height H of a postage imprint 10 represented by the dashed outline rectangle on the item 1. Thus the dimension of each row of nozzles and the height of the postage imprint determine the number of nozzles required to print the postage imprint.

If possible, the two modules 20, 21 are mounted so that the last nozzle B128 of the module 20 (that of the uppermost module 20 in FIG. 1) is spaced from the first nozzle B́1 of the module 21 (that of the lowermost module 21 in FIG. 1) by a distance equal to approximately 0.127 millimeter in the direction perpendicular to the direction F (i.e. by the distance between two consecutive nozzles in either row of nozzles).

Because of the overall size of the modules, the two rows of nozzles R1 and R2 are spaced from each other by a distance D of approximately 1 cm in the direction F.

The franking machine further includes a control unit 3 such as a microprocessor and a program stored in a memory, not shown, which is connected to control the chronological succession of ejection of droplets of ink from the nozzles in response to a clock signal 22, 23 which may or may not be synchronized with a speed of movement V of the letter or the label under the printhead 2 so that it is possible to produce dots on the letter or the label that merge with each other with a slight overlap along straight lines parallel to the direction F.

To print a linear mark across the direction F and which extends over virtually all of the height H of the postage imprint 10 (like the upright of the character P shown in FIG. 1), the unit 3 delays the command to eject droplets of ink from the nozzles of the row R2 (the nozzles of the module 21 which is farther downstream in the direction F) relative to the command to eject droplets of ink from the nozzles of the row R1 (the nozzles of the module 20 which is farther upstream in the direction F) by a time-delay R varying with the ratio d/V, where d is the adjustment data previously stored in memory and representative of the distance D.

Because of module manufacturing tolerances, the distance D varies from one printhead to another and it is therefore necessary to adjust it after fitting the modules 20 and 21 into the franking machine.

Figure 4:
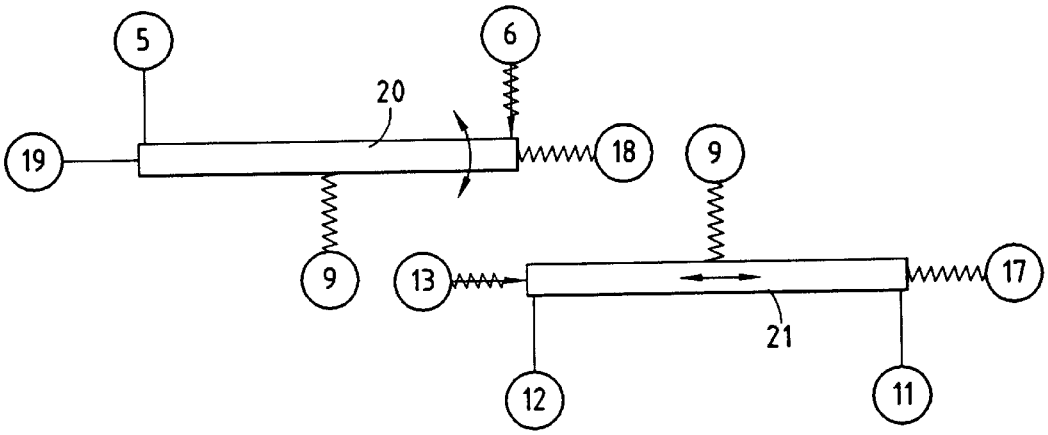
FIG. 4 is a diagram illustrating the operation of the adjustment device from FIGS. 2 and 3.

In accordance with the invention, the printhead is an interchangeable unit which can be mounted on the franking machine without requiring any adjustment. Only the relative immobilization of the two rows of nozzles of the printhead is carried out accurately in accordance with the principle defined hereinafter with reference to FIG. 4 and compensates for the cumulative manufacturing tolerances inherent to the rows of nozzles and to the interchangeable support member.

Figure 2:
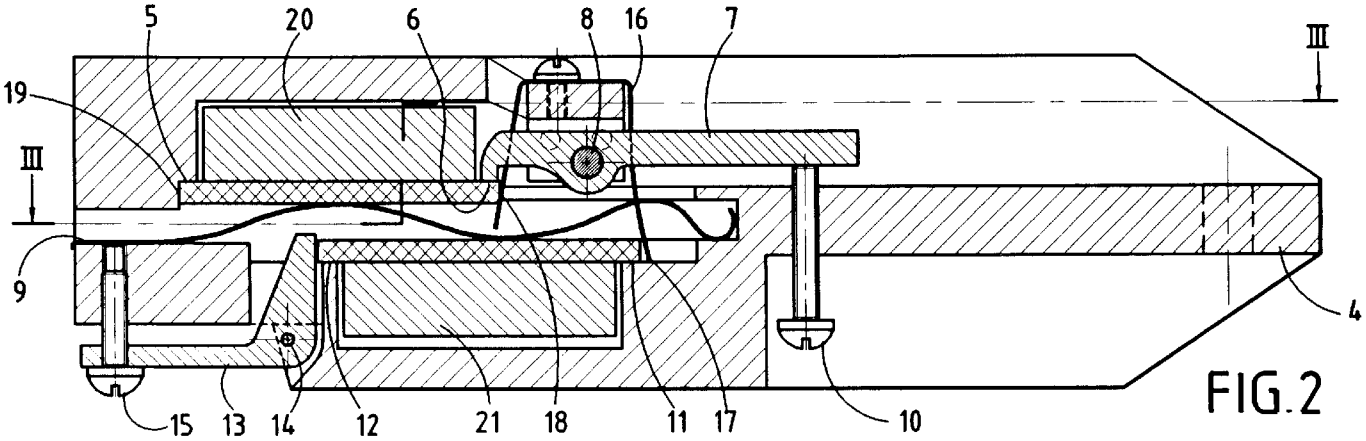
FIG. 2 is a plan view of a printhead of the invention with an integral alignment adjustment device.
Figure 3:
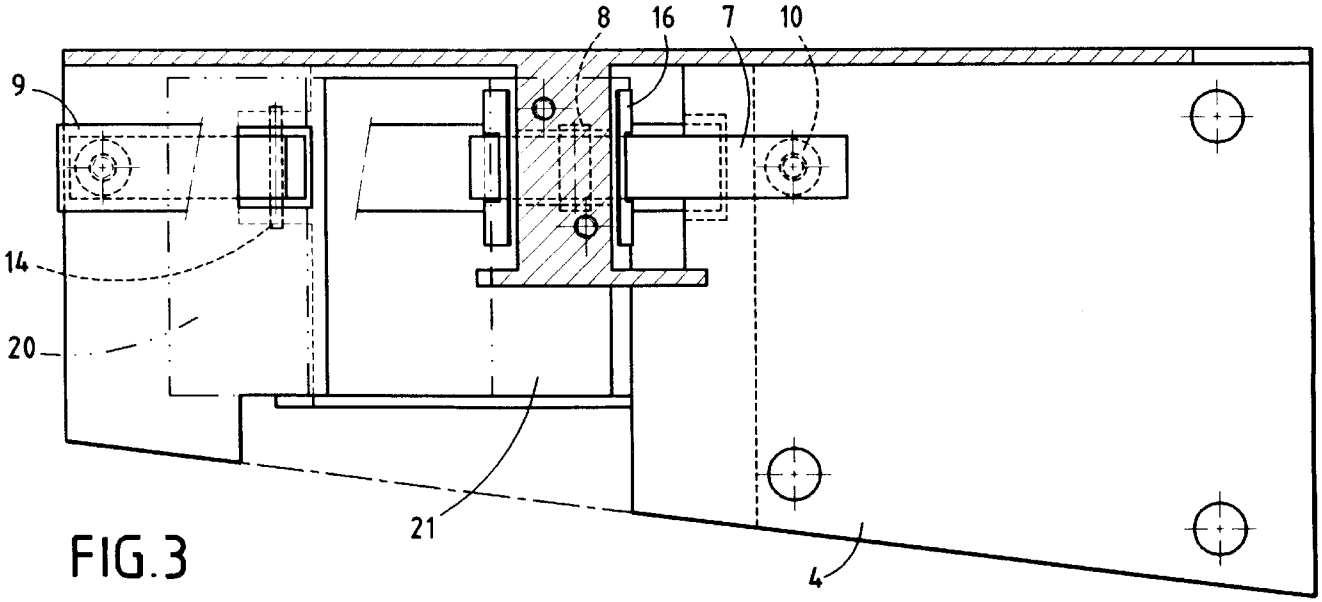
FIG. 3 is a view taken along the line III—III in FIG. 2.

FIGS. 2 and 3 show the structure of the printhead of the invention provided with an integral alignment adjustment device. The printhead 2 includes a member or body 4 for supporting the modules 20, 21 each including a row R1, R2 of ejector nozzles. The first module 20 is mounted longitudinally between a first fixed support 5 and a first mobile support 6 consisting of one end of a first lever 7 that can be adjusted in rotation. This first lever pivots on a first pivot pin 8 fixed to the body 4 against a first spring member, advantageously a leaf spring 9, which applies a compression force in a middle area of the first module 20. A first fine-pitch lockable screw 10 causes the end of the first lever to pivot about this first pivot pin which causes the module to oscillate about the first fixed support to assure an angular movement. The second module 21 is mounted longitudinally between second and third fixed supports 11, 12 onto which it is pressed by a spring member, preferably the same leaf spring 9, which applies a compression force in the middle area of the second module. A second lever 13 adjustable in translation constituting a second mobile support and which is oscillated about a second pivot pin 14 by a second fine-pitch lockable screw 15 moves the second module 21 transversely, parallel to the fixed supports, against a U-shaped second spring member 16 a first end part 17 of which retains this module. The other end part 18 of this second spring member 16 presses the first module 20 transversely against an abutment 19 on the body 4 of the printhead.

If R1 and R2 are the two rows of nozzles of the printhead 2 respectively corresponding to the module 20, 21 (see FIG. 4), the alignment of the nozzles is adjusted very simply by firstly carrying out an adjustment in translation (in a direction transverse to the direction of movement F) for one of the two rows, for example row R2, using the second lever 13 and the second screw 15 and then carrying out an angular adjustment (through an angle that is determined relative to the direction transverse to the direction of movement F) for the other row, i.e. row R1, using the first lever 7 and the first screw 10, so that one of the end nozzles, preferably the last nozzle B128 of this last row R1, is made to coincide (allowing, of course, for the ejection time-delay R between the rows of nozzles) with one of the end nozzles, preferably the first nozzle B́1, of the row of nozzles R2 previously adjusted in translation (linearly). In a different embodiment, one of the end nozzles of the row R2 is positioned on the axis of the nozzles and the other row R1 and spaced by one pitch from the end nozzle B́1 of the latter. This coincidence is verified in a manner known in itself on an optical adjustment bench or by trial and error during printing, after fitting to the franking machine.

Note that despite the relatively small number of components in the design of the invention, particularly accurate adjustment by simple fine-pitch screws (not micrometer screws) can be effected with maximum reliability. The printhead adjusted in this way can then be mounted directly in the franking machine without further adjustment.

What is claimed is:

1. An inkjet printhead for a franking machine for printing a postage imprint on a mail item to be franked, said item being displaced relative to the printhead in a movement direction, said printhead comprising:

a plurality of nozzles disposed in two rows extending transversely to the direction of movement, said two rows of nozzles being mounted in respective first and second modules which are mutually offset both transversely and lengthwise relative to the direction of movement and which are spaced apart from each other by a distance D in said direction, said modules each having a central portion and each being supported in a body of the printhead, first means for moving one of said first and second modules in a direction transverse to the movement direction, and second means for moving the other of said first and second modules through an angle relative to said direction transverse to the movement direction, said angle being determined so that during printing, two nozzles, disposed at each of proximate ends of said two rows, are aligned in a movement direction with one another.

2. The printhead according to claim 1, wherein said first means comprises:

a first fixed support which supports said first module longitudinally;

a fixed abutment fastened to said body and against which said fixed support abuts, a first spring member disposed between said first module and said second module, and which applies a compression force to said central portion of said first module, and a compression force to said central portion of said second module, and a second spring member which applies a force to said first module to fix said first module into said body, such that said first module is disposed transversely between said fixed abutment and said second spring member.

3. The printhead according to claim 2, wherein said second means comprises first mobile support means which moves one end of said first module around said first fixed support, said first mobile support means comprising one end of a first lever that is pivoted about a first pivot pin fastened to the body by a first screw to cause angular movement of one end of the first module around the first fixed support on which the other end of the first module is supported, to align said two nozzles in a movement direction.

4. The printhead according to claim 1, wherein said first means comprises:

a second fixed support, and a third fixed support, disposed on either of two sides of said second module, which support said second module longitudinally;

second mobile support means which moves one end of said second module around said second fixed support;

a first spring member disposed between said first module and said second module, and which applies a compression force to said central portion of said first module, and a compression force to said central portion of said second module; and a second spring member which applies a force to said first module to fix said first module into said body;

wherein said first spring member applies a compression force transversely between said second spring member and said second mobile support means;

wherein the second module is fixed into the body longitudinally between said second and said third fixed supports.

5. The printhead according to claim 4, wherein said second mobile support means comprises one end of a second lever that is pivoted about a second pivot pin fastened to the body by a second screw so as to cause transverse movement of the second module to align said two nozzles in a movement direction.

6. The printhead according to anyone of claims 3 and 5, wherein said first and second screws are lockable fine-pitch screws.

7. The printhead according to claim 2, wherein said first spring member is a leaf spring.

* * * * *